US006240654B1

(12) United States Patent
Weber et al.

(10) Patent No.: US 6,240,654 B1
(45) Date of Patent: Jun. 5, 2001

(54) PROCESS FOR CAPILLARY DEWATERING OF FOAM MATERIALS AND FOAM MATERIALS PRODUCED THEREBY

(75) Inventors: Gerald Martin Weber, Loveland; Osman Polat; Daniel Joseph Valerio, Jr., both of Cincinnati; Kofi Aduwusu, Liberty Township; Thomas Allen Desmarais, Cincinnati, all of OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 0 days.

(21) Appl. No.: 09/687,280

(22) Filed: Oct. 13, 2000

Related U.S. Application Data

(62) Division of application No. 09/352,108, filed on Jul. 14, 1999, now Pat. No. 6,158,144.

(51) Int. Cl.[7] ..... F26B 3/00

(52) U.S. Cl. ..... 34/335; 34/399; 34/400; 34/422; 34/71; 34/95.3; 34/111; 34/659; 156/78; 516/21; 521/50

(58) Field of Search ..... 34/69, 70, 71, 34/240, 397, 398, 399, 400, 329, 330, 332, 335, 418, 419, 422, 95.3, 111; 604/358, 369, 378, 384; 156/77, 78; 516/20, 21, 22; 428/12, 71; 521/50, 65, 56

(56) References Cited

U.S. PATENT DOCUMENTS 5,869,171 * 2/1999 Shiveley et al. ..... 428/304.4
6,027,795 * 2/2000 Kabra et al. ..... 428/305.5

* cited by examiner

*Primary Examiner*—Pamela Wilson
(74) *Attorney, Agent, or Firm*—Larry L. Huston; Edward J. Milbrada; Steven W. Miller

(57) ABSTRACT

A method and several exemplary apparatus for capillary dewatering of foam materials. The apparatus may include felt which is applied to an exposed face of the foam material, or a double felt arrangement applied to two opposed surfaces of the foam material. The apparatus may provide a temperature differential between the two exposed surfaces of the foam material. An alternative embodiment utilizes a roll having a capillary dewatering medium. The capillary dewatering medium may be maintained at a vacuum either above or below the breakthrough vacuum of the capillaries. The disclosed apparatus and method is particularly useful for dewatering foams having relatively fine open capillaries.

19 Claims, 4 Drawing Sheets

PROCESS FOR CAPILLARY DEWATERING OF FOAM MATERIALS AND FOAM MATERIALS PRODUCED THEREBY

This application is a divisionof U.S. Serial No. 09/352, 108filed Jul. 14, 1999, now U.S. Pat. No. 6,158,144.

FIELD OF THE INVENTION

This invention relates to drying foam materials, and more particularly to drying foam materials by using capillary media to remove moisture.

BACKGROUND OF THE INVENTION

Foam materials are well known in the art. Foam materials typically include a solid continuous phase which comprises struts, as well as cells. The cells may comprise a continuous phase as occurs in bicontinuous phase open cell foams.

The foams useful with the present invention may relate to relatively thin, collapsed (i.e. unexpanded), polymeric foam materials that, upon contact with aqueous body fluids, expand and absorb such fluids. These absorbent polymeric foam materials comprise a hydrophilic, flexible, nonionic polymeric foam structure of interconnected open-cells that provides a specific surface area per foam volume of at least about 0.025 $m^2$/cc. The foam structure has incorporated therein at least about 0.1% by weight of a toxicologically acceptable, hygroscopic, hydrated salt. In its collapsed state, the foam structure has an expansion pressure of about 30,000 Pascals or less. In its expanded state, the foam structure has a density, when saturated at 88° F. (31.1° C.) to its free absorbent capacity with synthetic urine having a surface tension of 65±5 dynes/cm, of from about 10 to about 50% of its dry basis density in its collapsed state.

While specific examples will vary, experience has shown that the foam material must be generally able to acquire aqueous fluids of nominal surface tensions against a total pressure (desorption plus gravitational) of at least about 40 cm, suitably at least about 50 cm, more suitably at least about 60 cm, and most suitably at least about 70 cm.

The overall capacity of the foam material is also quite important. While many materials such as fibrous webs may be densified so as to acquire fluids against a total pressure of about 40 to 70 cm, the capacity or void volume of such components is poor, typically less than about 2–3 g/g at 40 cm. Densification also decreases the capacity at 0 cm. Further, such webs tend to collapse under pressure (hydrostatic and mechanical) due to poor mechanical strength, further reducing their effective capacities. Even the absorbent foams described in the art for use as foam materials tend to collapse when subjected to pressures equivalent to more than about 30–40 cm of hydrostatic pressure. (Hydrostatic pressure is equivalent to mechanical pressure wherein 1 psi (7 kPa) mechanical pressure is equivalent to about 70 cm of hydrostatic pressure.) This collapse again substantially reduces (usually by a factor of between about 5 and 8) the useful capacity of these foams. While this reduced capacity can in principle be overcome by use of more absorbent material, this is generally impracticable due to cost and thinness considerations.

A third important parameter for a foam material is the ability to stay thin prior to imbibing aqueous fluids, expanding rapidly upon exposure to the fluid. This feature is described in more detail in U.S. Pat. No. 5,387,207, incorporated herein by reference. This affords a product which is relatively thin until it becomes saturated with fluid at the end of its wearing cycle. This "thin-until-wet" property is contingent upon the balancing of capillary pressures developed within the foam and foam strength, as described in U.S. Pat. No. 5,387,207.

It is believed that the ability of the polymeric foams of the present invention to remain in a collapsed, unexpanded state is due to the capillary pressures developed within the collapsed foam structure that at least equals the force exerted by the elastic recovery tendency (i.e., expansion pressure) of the compressed polymer. Surprisingly, these collapsed polymeric foam materials remain relatively thin during normal shipping, storage and use conditions, until ultimately wetted with aqueous body fluids, at which point they expand. Because of their excellent absorbency characteristics, including capillary fluid transport capability, these collapsed polymeric foam materials are extremely useful in high performance absorbent cores for absorbent articles such as diapers, adult incontinence pads or briefs, sanitary napkins, and the like. These collapsed polymeric foam materials are also sufficiently flexible and soft so as to provide a high degree of comfort to the wearer of the absorbent article.

Such relatively thin, collapsed polymeric foam materials are obtainable by polymerizing a specific type of water-in-oil emulsion having a relatively small amount of an oil phase and a relatively greater amount of a water phase, commonly known in the art as High Internal Phase Emulsions or "HIPE." The oil phase of these HIPE emulsions comprises from about 67 to about 98% by weight of a monomer component having: (a) from about 5 to about 40% by weight of a substantially water-insoluble, monofunctional glassy monomer; (b) from about 30 to about 80% by weight of a substantially water-insoluble, monofunctional rubbery comonomer; (c) from about 10 to about 40% by weight of a substantially water-insoluble polyfunctional crosslinking agent component. The oil phase further comprises from about 2 to about 33% by weight of an emulsifier component that is soluble in the oil phase and will provide a stable emulsion for polymerization. The water or "internal" phase of these HIPE emulsions comprises an aqueous solution containing from about 0.2 to about 20% by weight of a water-soluble electrolyte. The weight ratio of the water phase to the oil phase in these HIPE emulsion may range from about 12:1 to about 100:1. The polymerized foam is subsequently dewatered (with or without prior washing/treatment steps) to provide the collapsed foam material.

The foam material may be used as a storage element in an absorbent article. An important characteristic of the storage element is the ability to wick fluid within itself. Wherein the overlap between an acquisition or distribution component and the storage element is only partial, the storage component must itself be able to wick fluid throughout itself to be efficient.

It is also desirable that the storage element be sufficiently tough to survive during use and manufacture, sufficiently flexible to be comfortable, and amenable to manufacture using commercially viable procedures for large scale production.

Various techniques have been attempted in the art to remove fluids indigenous to manufacture of the foam material. For example, evaporative drying under ambient conditions (while not requiring a significant capital outlay) does not yield a drying rate which economically produces foam materials. Infra-red drying of foam materials requires expensive equipment and may produce moisture gradients in large quantities of the foam materials—thereby destroying any economies of scale. Thus, the foam materials must be economically dried.

Furthermore, such foams must be dried to the proper moisture level. If regions in the foam are overdried, random and uncontrolled swelling of such regions may occur. Such random swelling makes it difficult to reliably incorporate the foam absorbent materials into consumer products. Further, such random swelling makes it difficult to predict the ultimate performance of such foam materials at the point of use by the consumer. Thus, the foam materials must be uniformly dried to the proper moisture level.

Accordingly, there exists a need in the art for processes to economically dry foam materials, particularly foam absorbent materials, high internal phase emulsion foams, and other foams having relatively small-sized capillary networks. Further, there exists a need in the art to uniformly dry relatively large quantities of such materials. Finally, there exists a need in the art to uniformly dry such materials to a desired moisture level.

SUMMARY OF THE INVENTION

The invention comprises a process of removing moisture from any foam material which is wet prior to curing. The process comprises the steps of providing such a foam material. The foam material is suitable in sheet form, although any form having at least one exposed surface will suffice. The foam material has capillaries and moisture contained in the capillaries.

A capillary dewatering member is also provided. The capillary dewatering member is brought into contact with the exposed surface of the foam material, whereby moisture is removed from the foam material into the capillary dewatering member.

The capillary dewatering member may be provided in the form of a cover for rolls forming a nip, or endless belts. The capillary dewatering member may comprise cellulose, felt, or a permeable screen.

DETAILED DESCRIPTION OF THE INVENTION

Figure 1:
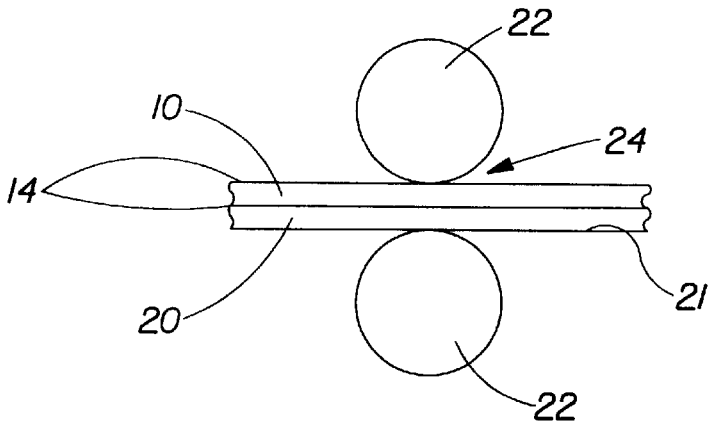
FIG. 1 is a schematic side elevational view of a nip utilizing a single felt arrangement to dewater the foam material.

The process of the present invention may utilize any foam material 10 which is wet upon manufacture, although it is particularly applicable to and useful for foam materials 10 having an open network of capillaries with a size less than 200, particularly less than 100, more particularly less than 50 and even less than 25 microns. Any type of material may be utilized for the continuous phase of foam material 10, with vinyl polymer foams 10 being particularly suitable.

The foam material 10 is provided in a generally planar, sheet form as described below, although the method of the present invention is applicable to any embodiment of foam 10 having an exposed surface 14 with which the apparatus described below may be placed in contact. In sheet form, the foam material 10 defines an XY plane having first and second opposed and exposed surfaces. Perpendicular to the two opposed surfaces 14 of the foam material 10 is the Z-direction, which defines the caliper of the foam material 10. Caliper is measured with a 2.866 centimers diameter presser foot and applied load of 45 grams on the sample.

The foam material 10 may be provided in sheet form with widths ranging from 0.2 to 8 meters, with common widths ranging from 1 to 4 meters. The caliper of the foam 10 may range from 0.5 to 20 mm, with a suitable caliper ranging from 1 to 6 mm. Generally, a lesser caliper is suitable for handling and convenience in the final consumer product.

In sheet form, the foam material 10 may be provided in a continuous, indeterminate length so that the dewatering process may be carried out as a continuous process. Alternatively, in a less suitable embodiment, the foam material 10 may be provided in discrete individual units, and the dewatering process may be carried out as a batch process.

Polymeric foams of the type referred to herein can be characterized as the structures which result when a relatively monomer-free liquid is dispersed as droplets or "bubbles" in a polymerizable monomer-containing liquid, followed by polymerization of the monomers in the monomer-containing liquid which surrounds the droplets. The resulting polymerized dispersion can be in the form of a porous solidified structure which is an aggregate of cells, the boundaries or walls of which cells comprise solid polymerized material. The cells themselves contain the relatively monomer-free liquid which, prior to polymerization, had formed the droplets in the liquid dispersion.

As described more fully hereafter, the collapsed polymeric foam materials useful as absorbents in the present invention are typically prepared by polymerizing a particular type of water-in-oil emulsion. Such an emulsion is formed from a relatively small amount of a polymerizable monomer-containing oil phase and a relatively larger amount of a relatively monomer-free water phase. The relatively monomer-free, discontinuous "internal" water phase thus forms the dispersed droplets surrounded by the continuous monomer-containing oil phase. Subsequent polymerization of the monomers in the continuous oil phase forms the cellular foam structure. The aqueous liquid remaining in the foam structure after polymerization can be removed by pressing, thermal drying and/or vacuum dewatering.

Polymeric foams, including foams prepared from water-in-oil emulsions, can be relatively closed-celled or relatively open-celled in character, depending upon whether and/or the extent to which, the cell walls or boundaries, i.e., the cell windows, are filled with, or void of, polymeric material. The polymeric foam materials useful in the absorbent articles and structures of the present invention are those which are relatively open-celled in that the individual cells of the foam are for the most part not completely isolated from each other by polymeric material of the cell walls. Thus the cells in such substantially open-celled foam structures have intercellular openings or "windows" which are large enough to permit ready fluid transfer from one cell to the other within the foam structure.

In substantially open-celled structures of the type useful herein, the foam will generally have a reticulated character with the individual cells being defined by a plurality of mutually connected, three dimensionally branched webs. The strands of polymeric material which make up the branched webs of the open-cell foam structure can be referred to as "struts." For purposes of the present invention, a foam material is "open-celled" if at least 80% of the cells in the foam structure that are at least 1 micron size are in fluid communication with at least one adjacent cell. Alternatively, a foam material can be considered to be substantially open-celled if it has a measured available pore volume that is at least 80% of the theoretically available pore volume, e.g., as determined by the water-to-oil weight ratio of the HIPE emulsion from which the foam material is formed.

In addition to being open-celled, the collapsed polymeric foam materials of this invention may be hydrophilic. The foams herein must be sufficiently hydrophilic to permit the foam to absorb aqueous body fluids in the amounts hereafter specified. The internal surfaces of the foam structures herein can be rendered hydrophilic by virtue of residual hydrophilizing agents left in the foam structure after polymerization or by virtue of selected post-polymerization foam treatment procedures which can be used to alter the surface energy of the material which forms the foam structure.

The extent to which these foam materials are "hydrophilic" can be quantified by the "adhesion tension" value exhibited when in contact with an absorbable test liquid. The adhesion tension exhibited by these foam materials can be determined experimentally using a procedure where weight uptake of a test liquid, e.g., synthetic urine, is measured for a sample of known dimensions and capillary suction specific surface area. Such a procedure is described in greater detail in the Test Methods section of U.S. Pat. No. 5,387,207, incorporated herein by reference. Foam materials which are useful as absorbents in the present invention are generally those which exhibit an adhesion tension value of from about 15 to about 65 dynes/cm, more suitable from about 20 to about 65 dynes/cm, as determined by capillary absorption of synthetic urine having a surface tension of 65±5 dynes/cm.

The collapsed polymeric foam materials of the present invention are obtainable by and usually obtained by polymerizing a HIPE-type emulsion as described hereafter. These are water-in-oil emulsions having a relatively small amount of an oil phase and a relatively greater amount of a water phase. Accordingly, after polymerization, the resulting foam contains a substantial amount of water.

The polymeric foam material of the present invention may have residual water that includes both the water of hydration associated with the hydroscopic, hydrated salt incorporated therein (as described hereafter), as well as free water absorbed within the foam. It is this residual water (assisted by the hydrated salts) that is believed to exert capillary pressures on the resulting collapsed foam structure. Collapsed polymeric foam materials of the present invention can have residual water contents of at least about 4%, typically from about 4 to about 30%, by weight of the foam when stored at ambient conditions of 72° F. (22° C.) and 50% relative humidity. Suitable collapsed polymeric foam materials of the present invention have residual water contents of from about 5 to about 17% by weight of the foam.

Polymeric foam materials useful with the present invention can be prepared by polymerization of certain water-in-oil emulsions having a relatively high ratio of water phase to oil phase. Emulsions of this type which have these relatively high water to oil phase ratios are commonly known in the art as high internal phase emulsions ("HIPEs" or "HIPE" emulsions). The polymeric foam materials which result from the polymerization of such emulsions are referred to herein as "HIPE foams."

The chemical nature, makeup and morphology of the polymer material which forms the HIPE foam structures herein is determined by both the type and concentration of the monomers, comonomers and crosslinkers utilized in the HIPE emulsion and by the emulsion formation and polymerization conditions employed. No matter what the particular monomeric makeup, molecular weight or morphology of the polymeric material might be, the resulting polymeric foams will generally be viscoelastic in character, i.e. the foam structures will possess both viscous, i.e. fluid-like, properties and elastic, i.e. spring-like, properties. It is also important that the polymeric material which forms the cellular foam structure have physical, Theological, and morphological attributes which, under conditions of use, impart suitable flexibility, resistance to compression deflection, and dimensional stability to the absorbent foam material.

The relative amounts of the water and oil phases used to form the HIPE emulsions are, among many other parameters, important in determining the structural, mechanical and performance properties of the resulting polymeric foams. In particular, the ratio of water to oil in the foam-forming emulsion can influence the foam density, cell size, and capillary suction specific surface area of the foam and dimensions of the struts which form the foam. The emulsions used to prepare the HIPE foams of this invention will generally have water-to-oil phase ratios ranging from about 12:1 to about 100:1, more suitably from about 30:1 to about 75:1, most suitably from about 30:1 to about 65:1.

Following compression and/or dewatering, the foam materials can reexpand when wetted with aqueous fluids. Surprisingly, these foam materials remain in the collapsed, or unexpanded, state indefinitely when stored under conditions typical for such products during storage, shipment, display, and before use. After compression and/or dewatering to a practicable extent, these foam materials have residual water that includes both the water of hydration associated with the hygroscopic, hydrated salt incorporated therein, as well as free water absorbed within the foam material. This residual water (assisted by the hydrated salts) is believed to exert capillary pressures on the resulting collapsed foam structure.

An important parameter of these foam materials is their glass transition temperature (Tg). The Tg represents the midpoint of the transition between the glassy and rubbery states of the polymer. Foam materials that have a higher Tg than the temperature of use can be very strong but may be very rigid and potentially prone to fracture. Such foam materials also typically take a long time to recover to the expanded state when wetted with aqueous fluids colder than the Tg of the polymer after having been stored in the collapsed state for prolonged periods. The desired combination of mechanical properties, specifically strength and resilience, typically necessitates a fairly selective range of monomer types and levels to achieve these desired properties.

For foam materials of the present invention, the Tg of the polymer may be at least about 10° C. lower than the in-use temperature. Accordingly, monomers are selected as much as possible that provide corresponding homopolymers having lower Tg's. The Tg is derived from the loss tangent (tan[δ]) vs. temperature curve from a dynamic mechanical analysis (DMA) measurement, as described in U.S. Pat. No. 5,633,291 (Dyer et al.) issued May 27, 1997, incorporated herein by reference.

A. Oil Phase Components

The continuous oil phase of the HIPE emulsion comprises monomers that are polymerized to form the solid foam structure. This monomer component includes a "glassy" monomer, a "rubbery" comonomer and a cross-linking agent. Selection of particular types and amounts of monofunctional monomer(s) and comonomer(s) and polyfunctional cross-linking agent(s) can be important to the realization of absorbent HIPE foams having the desired combination of structure, mechanical, and fluid handling properties which render such materials suitable for use in the invention herein. Other oil phase adjuvants include emulsifiers, antioxidants, pigments and alike as detailed in U.S. Pat. No. 5,563,179, incorporated herein by reference.

The monomer component utilized in the oil phase of the HIPE emulsions comprises one or more monofunctional monomers that tend to impart glass-like properties to the resulting polymeric foam structure. Such monomers are referred to as "glassy" monomers, and are, for purposes of this invention, defined as monomeric materials which would produce high molecular weight (greater than 6000) homopolymers having a glass transition temperature, $T_g$, above about 40° C. These monofunctional glassy monomer types include methacrylate-based monomers (e.g., methyl methacrylate) and styrene-based monomers (e.g., styrene). One suitable monofunctional glassy monomer type is a styrene-based monomer, with styrene itself being the most suitable monomer of this kind. Substituted, e.g., monosubstituted, styrene such as p-methylstyrene can also be employed. The monofunctional glassy monomer will normally comprise from about 5 to about 40%, more suitably from about 10 to about 30%, even more suitably from about 15 to about 25%, and most suitably about 20%, by weight of the monomer component.

The monomer component also comprises one or more monofunctional comonomers which tend to impart rubber-like properties to the resulting polymeric foam structure. Such comonomers are referred to as "rubbery" comonomers and are, for purposes of this invention, defined as monomeric materials which would produce high molecular weight (greater than 10,000) homopolymers having a glass transition temperature, $T_g$, of about 40° C. or lower. Monofunctional rubbery comonomers of this type include, for example, the $C_4$–$C_{12}$ alkyl-acrylates, the $C_6$–$C_{14}$ alkylmethacrylates, and combinations of such comonomers. Of these comonomers, n-butylacrylate and 2-ethylhexylacrylate are the most suitable. The monofunctional rubbery comonomer will generally comprise from about 30 to about 80%, more suitably from about 50 to about 70%, and most suitably from about 55 to about 65%, by weight of the monomer component.

Since the polymer chains formed from the glassy monomer(s) and the rubbery comonomer(s) are to be cross-linked, the monomer component also contains a polyfunctional cross-linking agent. As with the monofunctional monomers and comonomers, selection of a particular type and amount of cross-linking agent is very important to the eventual realization of suitable polymeric foams having the desired combination of structural, mechanical, and fluid-handling properties.

Depending upon the type and amounts of monofunctional monomers and comonomers utilized, and depending further upon the desired characteristics of the resulting polymeric foams, the polyfunctional cross-linking agent can be selected from a wide variety of polyfunctional, suitable difunctional, monomers. Thus, the cross-linking agent can be a divinyl aromatic material such as divinylbenzene, divinyltolulene or diallylphthalate. Alternatively, divinyl aliphatic cross-linkers such as any of the diacrylic or dimethylacrylic acid esters of polyols, such as 1,6-hexanediol and its homologues, can be utilized. The cross-linking agent found to be suitable for preparing the HIPE emulsions is divinylbenzene. The cross-linking agent of whatever type will generally be employed in the oil phase of the foam-forming emulsions herein in an amount of from about 10 to about 40%, more suitably from about 15 to about 25%, and most suitably about 20%, by weight of the monomer component.

The major portion of the oil phase of the HIPE emulsions will comprise the aforementioned monomers, comonomers and crosslinking agents. It is essential that these monomers, comonomers and cross-linking agents be substantially water-insoluble so that they are primarily soluble in the oil phase and not the water phase. Use of such substantially water-insoluble monomers insures that HIPE emulsions of appropriate characteristics and stability will be realized.

The monomers, comonomers and cross-linking agents used herein may be of the type such that the resulting polymeric foam is suitably non-toxic and appropriately chemically stable. These monomers, comonomers and cross-linking agents should have little or no toxicity, if present at very low residual concentrations during post-polymerization foam processing and/or use.

Another essential component of the oil phase is an emulsifier which permits the formation of stable HIPE emulsions. Such emulsifiers are those which are soluble in the oil phase used to form the emulsion. Emulsifiers utilized are typically nonionic and include the sorbitan fatty acid esters, the polyglycerol fatty acid esters, and combinations thereof. Suitable emulsifiers include diglycerol monooleate, sorbitan laurate (e.g., SPAN® 20), sorbitan oleate (e.g., SPANS® 80), combinations of sorbitan laurate and sorbitan palmitate (e.g., SPAN® 40) in a weight ratio of from about 1:1 to about 3:1, and especially combinations of sorbitan laurate with certain polyglycerol fatty acid esters to be described hereafter.

The oil phase used to form the HIPE emulsions will generally comprise from about 67 to about 98% by weight monomer component and from about 2 to about 33% by weight emulsifier component. The oil phase may comprise from about 80 to about 95% by weight monomer component and from about 5 to about 20% by weight emulsifier component.

In addition to the monomer and emulsifier components, the oil phase can contain other optional components. One such optional oil phase component is an oil soluble polymerization initiator of the general type hereafter described. Another possible optional component of the oil phase is a substantially water insoluble solvent for the monomer and emulsifier components. A solvent of this type must, of course, not be capable of dissolving the resulting polymeric foam. If such a solvent is employed, it will generally comprise no more than about 10% by weight of the oil phase.

B. Water Phase Components

The discontinuous internal phase of the HIPE emulsions is the water phase which will generally be an aqueous solution containing one or more dissolved components. One essential dissolved component of the water phase is a water-soluble electrolyte. The dissolved electrolyte in the water phase of the HIPE emulsion serves to minimize the tendency of monomers and crosslinkers which are primarily oil soluble to also dissolve in the water phase. This, in turn, is believed to minimize the extent to which, during polymerization of the emulsion, polymeric material fills the cell windows at the oil/water interfaces formed by the water phase droplets. Thus, the presence of electrolyte and the resulting ionic strength of the water phase is believed to determine whether and to what degree the resulting polymeric foams can be open-celled.

Any electrolyte which provides ionic species to impart ionic strength to the water phase can be used. Suitable electrolytes are mono-, di-, or tri-valent inorganic salts such as the water-soluble halides, e.g., chlorides, nitrates and sulfates of alkali metals and alkaline earth metals. Examples include sodium chloride, calcium chloride, sodium sulfate and magnesium sulfate. Calcium chloride is suitable for use in the present invention. Generally the electrolyte will be utilized in the water phase of the HIPE emulsions in a concentration in the range of from about 0.2 to about 20% by weight of the water phase. More suitably, the electrolyte will comprise from about 1 to about 10% by weight of the water phase.

The HIPE emulsions will also typically contain a polymerization initiator. Such an initiator component is generally added to the water phase of the HIPE emulsions and can be any conventional water-soluble free radical initiator. Materials of this type include peroxygen compounds such as sodium, potassium and ammonium persulfates, hydrogen peroxide, sodium peracetate, sodium percarbonate and the like. Conventional redox initiator systems can also be utilized. Such systems are formed by combining the foregoing peroxygen compounds with reducing agents such as sodium bisulfite, L-ascorbic acid or ferrous salts.

The initiator material can comprise up to about 5 mole percent based on the total moles of polymerizable monomers present in the oil phase. More suitably, the initiator comprises from about 0.001 to 0.5 mole percent based on the total moles of polymerizable monomers in the oil phase. When used in the water-phase, such initiator concentrations can be realized by adding initiator to the water phase to the extent of from about 0.005% to about 0.4%, and more suitably from about 0.006% to about 0.2%, by weight of the water phase.

C. Hydrophilizing Agents and Hydratable Salts

The cross-linked polymer material that forms the collapsed absorbent foam structures herein may be substantially free of polar functional groups on its polymeric structure. Thus, immediately after the polymerization step, the polymer material which forms the foam structure surfaces of such absorbent foams will normally be relatively hydrophobic in character. Accordingly, just-polymerized foams can need further treatment to render the foam structure surfaces relatively more hydrophilic so that such foams can be used as absorbents for aqueous body fluids. Hydrophilization of the foam surfaces, if necessary, can generally be accomplished by treating the polymerized HIPE foam structures with a hydrophilizing agent in a manner described more fully hereafter.

Hydrophilizing agents are any materials which will enhance the water wettability of the polymeric surfaces with which they are contacted and onto which they are deposited. Hydrophilizing agents are well known in the art, and can include surfactant materials, particularly of the nonionic type. Hydrophilizing agents will generally be employed in liquid form, and can be dissolved or dispersed in a hydrophilizing solution which is applied to the HIPE foam surfaces. In this manner, hydrophilizing agents can be adsorbed onto the polymeric surfaces of the HIPE foam structures in amounts suitable for rendering such surfaces substantially hydrophilic but without altering the desired flexibility and compression deflection characteristics of the foam. In foams which have been treated with hydrophilizing agents, the hydrophilizing agent is incorporated into the foam structure such that residual amounts of the agent which remain in the foam structure are in the range from about 0.5% to about 20%, and preferably from about 5 to about 12%, by weight of the foam.

One type of suitable hydrophilizing agent is a non-irritating oil-soluble surfactant. Such surfactants can include all of those previously described for use as the emulsifier for the oil phase of the HIPE emulsion, such as sorbitan laurate (e.g., SPAN® 20), and combinations of sorbitan laurate with certain polyglycerol fatty acid esters to be described hereafter. Such hydrophilizing surfactants can be incorporated into the foam during HIPE emulsion formation and polymerization or can be incorporated by treatment of the polymeric foam with a solution or suspension of the surfactant dissolved or dispersed in a suitable carrier or solvent.

Another material that needs to be incorporated into the HIPE foam structure is a hydratable, and suitable hygroscopic or deliquesent, water soluble inorganic salt. Such salts include, for example, toxicologically acceptable alkaline earth metal salts. Materials of this type and their use in conjunction with oil-soluble surfactants as the foam hydrophilizing agent is described in greater detail in commonly assigned U.S. Pat. No. 5,352,711 issued Oct. 11, 1984 to DesMarais, the disclosure of which is incorporated by reference. Suitable salts of this type include the calcium halides such as calcium chloride which, as previously noted, can also be employed as the electrolyte in the water phase of the HIPE emulsions used to prepare the polymeric foams.

Hydratable inorganic salts can easily be incorporated into the polymeric foams herein by treating the foams with aqueous solutions of such salts. Solutions of hydratable inorganic salts can generally be used to treat the foams after completion of, or as part of, the process of removing the residual water phase from the just-polymerized foams. Contact of foams with such solutions is suitably used to deposit hydratable inorganic salts such as calcium chloride in residual amounts of at least about 0.1% by weight of the foam, and typically in the range of from about 0.1 to about 10%, and more suitably from about 3 to about 8%, by weight of the foam.

Treatment of suitable foam structures which are relatively hydrophobic as polymerized with hydrophilizing agents (with or without hydratable salts) will typically be carried out to the extent that is necessary and sufficient to impart suitable hydrophilicity to the HIPE foams. Some foams of the HIPE emulsion type, however, can be suitably hydrophilic as prepared and can have incorporated therein sufficient amounts of hydratable salts, thus requiring no additional treatment with hydrophilizing agents or hydratable salts. In particular, such HIPE foams can be those wherein sorbitan fatty acid esters such as sorbitan laurate (e.g., SPAN® 20), or combinations of sorbitan laurate with certain polyglycerol fatty acid esters to be described hereafter, are used as emulsifiers added to the oil phase and calcium chloride is used as an electrolyte in the water phase of the HIPE emulsion. In that instance, the residual-emulsifier-containing internal polymerized foam surfaces will be suitably hydrophilic, and the residual water-phase liquid will contain or deposit sufficient amounts of calcium chloride, even after the polymeric foams have been dewatered.

The treatment of foam materials with a hydrophilizing surfactant is described in U.S. Pat. Nos. 5,563,179; 5,250,576; 5,292,777, the disclosures of which are incorporated herein by reference.

D. Processinq Conditions for Obtaining HIPE Foams

Foam preparation typically involves the steps of: 1) forming a stable high internal phase emulsion (HIPE); 2) polymerizing/curing this stable emulsion under conditions suitable for forming a solid polymeric foam structure; 3) washing the solid polymeric foam structure to remove the original residual water phase from the polymeric foam structure and, if necessary, treating the polymeric foam structure with a hydrophilizing agent and/or hydratable salt to deposit any needed hydrophilizing agent/hydratable salt, and 4) thereafter dewatering this polymeric foam structure (suitably including compression in the z-direction) to the extent necessary to provide a collapsed, unexpanded polymeric foam material useful as an absorbent for aqueous body fluids. These procedures are detailed in commonly assigned U.S. Pat. Nos. 5,563,179, 5,149,720 (DesMarais et al.), issued Sep. 22, 1992, and 5,827,909 (DesMarais) issued Oct. 27, 1998, which are incorporated herein by reference.

To consistently obtain relatively thin, collapsed polymeric foam materials according to the present invention, it has been found to be particularly important to carry out the emulsion formation and polymerization steps in a manner such that coalescence of the water droplets in the HIPE emulsion is reduced or minimized. HIPE emulsions are not always stable, particularly when subjected to higher temperature conditions to effect polymerization and curing. As the HIPE emulsion destabilizes, the water droplets present in it can aggregate together, and coalesce to form much large water droplets. Indeed, during polymerization and curing of the emulsion, there is essentially a race between solidification of the foam structure, and coalescence of the water droplets. An appropriate balance has to be struck such that coalescence of the water droplets is reduced, yet polymerization and curing of the foam structure can be carried out within a reasonable time. (While some coalescence can be tolerated if the remaining water droplets are very small in size, such nonuniform cell sizes in the resulting foam can adversely affect the fluid transport properties of the foam, especially its wicking rate.)

Reduction in the coalescence of water droplets in the HIPE emulsion leads to a smaller average cell size in the resulting foam structure after polymerization and curing. It is believed that this resulting smaller average cell size in the polymeric foam material is a key mechanism behind consistent formation of relatively thin, collapsed polymeric foam materials according to the present invention. (Uniformly small cell sizes in the resulting foam are also believed to lead to good absorbency, and especially fluid transport (e.g., wicking) characteristics.) The number average cell size of the polymeric foam materials is about 50 microns or less and is typically in the range from about 5 to about 50 microns, suitably from about 5 to about 40 microns, and more suitably from about 5 to about 35 microns, when prepared under conditions that reduce coalescence of water droplets in the HIPE emulsion. Techniques for consistently reducing coalescence of water droplets in the HIPE emulsion will be discussed in greater detail in the following description of the emulsion formation and polymerization/curing steps for obtaining collapsed polymeric foams.

One suitable method of forming HIPEs having a higher degree of cell uniformity involves a continuous process that combines and emulsifies the requisite oil and water phases. In the mixing chamber or zone (e.g., a cylinder), the combined streams are generally subjected to low shear agitation provided, for example, by a pin impeller of suitable configuration and dimensions. The use of low shear agitation provides a higher uniformity of cell sizes in the HIPE, which leads to foams having improved suction capabilities. With a pin impeller of the type used in the present process, both the impeller pin tip speed (hereafter referred to as "tip speed") and the gap between pin tip and the mixing chamber wall (referred to herein as "pin to wall gap", or "gap") are important to shear rate. The shear rate for pin impellers is herein defined as the tip speed divided by the pin to wall gap. For the purposes of this invention this combination variable, shear rate, should be not more than about 6000 $sec^{-1}$. A shear will typically be applied to the combined oil/water phase stream at a rate of not more than about 5400 $sec^{-1}$, and more suitably not more than about 5100 $sec^{-1}$. Typically, the shear rate used will be from about 3000 to about 6000 $sec^{-1}$, more typically from about 3000 to about 5400 $sec^{-1}$, still more typically from about 3300 to about 5100 $sec^{-1}$. Tip speeds should be from about 150 in/sec (381 cm/sec) to about 600 in/sec (1524 cm/sec), suitably from about 150 in/sec (381 cm/sec) to about 500 in/sec (1270 cm/sec), and more suitably from about 200 in/sec (508 cm/sec) to about 400 in/sec (1016 cm/sec). Pin to wall gap should be between 1% and 6% of the cylinder diameter, suitably between 1% and 4% of the cylinder diameter, and more suitably between 1.5% and 4% of the cylinder diameter.

1. Formation of HIPE Emulsion

The HIPE emulsion is formed by combining the oil phase components with the water phase components in the previously specified weight ratios. The oil phase will contain the previously specified essential components such as the requisite monomers, comonomers, crosslinkers and emulsifiers, and can also contain optional components such as solvents and polymerization initiators. The water phase used will contain the previously specified electrolytes as an essential component and can also contain optional components such as water-soluble emulsifiers, and/or polymerization initiators.

The HIPE emulsion can be formed from the combined oil and water phases by subjecting these combined phases to shear agitation. Shear agitation is generally applied to the extent and for a time period necessary to form a stable emulsion from the combined oil and water phases. Such a process can be conducted in either batchwise or continuous fashion and is generally carried out under conditions suitable for forming an emulsion wherein the water phase droplets are dispersed to such an extent that the resulting polymeric foam will have the requisite pore volume and other structural characteristics. Emulsification of the oil and water phase combination will frequently involve the use of a mixing or agitation device such as a pin impeller.

One suitable method of forming HIPE emulsions which can be employed herein involves a continuous process for combining and emulsifying the requisite oil and water phases. In such a process, a liquid stream comprising the oil phase is formed and provided at a flow rate ranging from about 0.08 to about 1.5 mL/sec. Concurrently, a liquid stream comprising the water phase is also formed and provided at a flow rate ranging from about 4 to about 50 mL/sec. At flow rates within the foregoing ranges, these two streams are then combined in a suitable mixing chamber or zone in a manner such that the requisite water to oil phase weight ratios as previously specified are approached, reached and maintained.

In the mixing chamber or zone, the combined streams are generally subjected to shear agitation as provided, for example, by a pin impeller of suitable configuration and dimensions. Residence times in the mixing chamber will frequently range from about 5 to about 30 seconds. Once formed, the stable HIPE emulsion in liquid form can be withdrawn from the mixing chamber or zone at a flow rate of from about 4 to about 52 musec. This method for forming HIPE emulsions via a continuous process is described in greater detail in U.S. Pat. No. 5,149,720 (DesMarais et al), issued Sep. 22, 1992, which is incorporated by reference.

In consistently reducing the coalescence of the water droplets present in the HIPE emulsion, one may use certain types of emulsifier systems in the oil phase, especially if the HIPE emulsion is to be polymerized or cured at temperatures of about 50° C. to about 100° C. These emulsifier systems comprise a combination of sorbitan laurate (e.g., SPAN® 20), and certain polyglycerol fatty acid esters (PGEs) as co-emulsifiers. The weight ratio of sorbitan laurate to PGE is usually within the range of from about 10:1 to about 1:10 and suitably in the range of from about 4:1 to about 1:1.

The PGEs especially useful as co-emulsifiers with sorbitan laurate are usually prepared from polyglycerols characterized by high levels of linear (i.e., acyclic) diglycerols, reduced levels of tri- or higher polyglycerols, and reduced levels of cyclic diglycerols. Suitable polyglycerol reactants (weight basis) usually have a linear diglycerol level of at least about 60% (typical range of from about 60 to about 90%), a tri- or higher polyglycerol level of no more than about 40% (typical range of from about 10 to about 40%), and a cyclic diglycerol level of no more than about 10% (typical range of from 0 to about 10%). Suitably, these polyglycerols have a linear diglycerol level of from about 60 to about 80%, a tri- or higher polyglycerol level of from about 20 to about 40%, and a cyclic diglycerol level of no more than about 10%.

PGEs especially useful as co-emulsifiers with sorbitan laurate are also prepared from fatty acid reactants characterized by fatty acid compositions having high levels of combined $C_{12}$ and $C_{14}$ saturated fatty acids, and reduced levels of other fatty acids. Suitable fatty acid reactants have fatty acid compositions where the combined level of $C_{12}$ and $C_{14}$ saturated fatty acids is at least about 40% (typical range of from about 40 to about 85%), the level of $C_{16}$ saturated fatty acid is no more than about 25% (typical range of from about 5 to about 25%), the combined level of $C_{18}$ or higher saturated fatty acids is no more than about 10% (typical range of from about 2 to about 10%), the combined level of $C_{10}$ or lower fatty acids is no more than about 10% (typical range of from about 0.3 to about 10%), the balance of other fatty acids being primarily $C_{18}$ monounsaturated fatty acids. Suitably, the fatty acid composition of these fatty acid reactants is at least about 65% combined $C_{12}$ and $C_{14}$ saturated fatty acids (typical range of from about 65 to about 75%), no more than about 15% $C_{16}$ saturated fatty acid (typical range of from about 10 to about 15%), no more than about 4% combined $C_{18}$ or higher saturated fatty acids (typical range of from about 2 to about 4%), and no more than about 3% $C_{10}$ or lower fatty acids (typical range of from about 0.3 to about 3%).

PGEs useful as co-emulsifiers with sorbitan laurate are also usually characterized as imparting a minimum oil/water interfacial tension (IFT), where the oil phase contains monomers used in the HIPE emulsion and the water phase contains calcium chloride. Suitable PGE co-emulsifiers usually impart a minimum oil/water IFT of at least about 0.06 dynes/cm, with a typical range of from about 0.06 to about 1.0 dynes/cm. Especially suitable PGEs impart a minimum oil/water IFT of at least about 0.09 dynes/cm, with a typical range of from about 0.09 to about 0.3 dynes/cm.

PGEs useful as coemulsifiers with sorbitan monolaurate can be prepared by methods well known in the art. See, for example, U.S. Pat. No. 3,637,774 (Babayan et al), issued Jan. 25, 1972, and McIntyre, "Polyglycerol Esters," *J. Am. Oil Chem. Soc.*, Vol. 56, No. 11 (1979), pp. 835A–840A, which are incorporated by reference and which describe methods for preparing polyglycerols and converting them to PGEs. PGEs are typically prepared by esterifying polyglycerols with fatty acids. Appropriate combinations of polyglycerols can be prepared by mixing polyglycerols obtained from commercial sources or synthesized using known methods, such as those described in U.S. Pat. No. 3,637,774. Appropriate combinations of fatty acids can be prepared by mixing fatty acids and/or mixtures of fatty acids obtained from commercial sources. In making PGEs useful as co-emulsifiers, the weight ratio of polyglycerol to fatty acid is usually from about 50:50 to 70:30, suitably from about 60:40 to about 70:30.

Typical reaction conditions for preparing suitable PGE co-emulsifiers involve esterifying the polyglycerols with fatty acids in the presence of 0.1–0.2% sodium hydroxide as the esterification catalyst. The reaction is initiated at atmospheric pressure at about 210°–220° C., under mechanical agitation and nitrogen sparging. As the reaction progresses, the free fatty acids diminish and the vacuum is gradually increased to about 8 mm Hg. When the free fatty acid level decreases to less than about 0.5%, the catalyst is then neutralized with a phosphoric acid solution and the reaction mixture rapidly cooled to about 60° C. This crude reaction mixture can then be subjected to settling or other conventional purification steps (e.g., to reduce the level unreacted polyglycerol) to yield the desired PGEs.

2. Polymerization/Curing of the HIPE Emulsion

The HIPE emulsion formed will generally be collected or poured in a suitable reaction vessel, container or region to be polymerized or cured. In one embodiment herein, the reaction vessel comprises a tub constructed of polyethylene from which the eventually polymerized/cured solid foam material can be easily removed for further processing after polymerization/curing has been carried out to the extent desired. It is usually suitable that the temperature at which the HIPE emulsion is poured into the vessel be approximately the same as the polymerization/curing temperature.

Polymerization/curing conditions to which the HIPE emulsion will be subjected will vary depending upon the monomer and other makeup of the oil and water phases of the emulsion, especially the emulsifier systems used, and the type and amounts of polymerization initiators utilized. Frequently, however, polymerization/curing conditions will comprise maintenance of the HIPE emulsion at elevated temperatures above about 50° C., and even up to about 80° C., for a time period ranging from about 1 to about 48 hours.

A bulk solid polymeric foam is typically obtained when the HIPE emulsion is polymerized/cured in a reaction vessel, such as a tub. This bulk polymerized HIPE foam is typically cut or sliced into a sheet-like form. Sheets of polymerized HIPE foam are easier to process during subsequent treating/washing and dewatering steps, as well as to prepare the HIPE foam for use in absorbent articles. The bulk polymerized HIPE foam is typically cut/sliced to provide a cut caliper in the range of from about 0.08 to about 2.5 cm. During subsequent dewatering, this typically leads to collapsed HIPE foams having a caliper in the range of from about 0.008 to about 1.25 cm.

3. Treating/Washing HIPE Foam

The solid polymerized HIPE foam which is formed will generally be a flexible, open-cell porous structure having its cells filled with the residual water phase material used to prepare the HIPE emulsion. This residual water phase material, which generally comprises an aqueous solution of electrolyte, residual emulsifier, and polymerization initiator, should be at least partially removed from the foam structure at this point prior to further processing and use of the foam. Removal of the original water phase material will usually be carried out by compressing the foam structure to squeeze out residual liquid and/or by washing the foam structure with water or other aqueous washing solutions. Frequently several compressing and washing steps, e.g., from 2 to 4 cycles, will be utilized.

After the original water phase material has been removed from the foam structure to the extent required, the HIPE foam, if needed, can be treated, e.g., by continued washing, with an aqueous solution of a suitable hydrophilizing agent and/or hydratable salt. Hydrophilizing agents and hydratable salts which can be employed have been previously described and include sorbitan laurate (e.g., SPAN® 20) and calcium chloride. As noted, treatment of the HIPE foam structure with the hydrophilizing agent/hydratable salt solution continues, if necessary, until the desired amount of hydrophilizing agent/hydratable salt has been incorporated and until the foam exhibits a desired adhesion tension value for any test liquid of choice.

The foregoing discussion is directed primarily to foam materials 10 which remains thin until wetted by liquids. Suitable foam materials 10 of this type may be made according to any of commonly assigned U.S. Pat. Nos. 5,387,207; 5,650,222; 5,652,194; 5,741,581; and 5,744,506, which patents are incorporated herein by reference.

Alternatively, the foam materials 10 useful with the present invention may be hydrophilic and remain relatively thick, i.e., exhibit no appreciable change in caliper upon wetting. Such foam materials 10 are illustrated in U.S. Pat. Nos. 5,260,345; 5,268,224; 5,331,015; 5,550,167; 5,563,179; 5,571,849; 5,632,737; 5,692,939; 5,849,805; 5,763,499; 5,786,395; 5,795,921; 5,851,648; and 5,873,869, which patents are incorporated herein by reference.

Alternatively, the present invention may be utilized with hydrophobic foam materials 10. Hydrophobic foam materials 10 are commonly used for their thermal insulating properties. Such foam materials 10 are illustrated in U.S. Pat. Nos. 5,633,291; 5,728,743; 5,753,359; and 5,770,634, which patents are incorporated herein by reference.

Alternatively, the present invention can be used with heterogeneous foam materials 10. Heterogeneous foam materials 10 are illustrated by U.S. Pat. Nos. 5,817,704; 5,856,366; and 5,869,171, which patents are incorporated herein by reference.

Referring to FIG. 1, for the process described below, a capillary dewatering member is provided. In one embodiment, the capillary dewatering member may be a felt 20 as is known in the art for drying tissue grades of paper. Suitable felts 20 typically have a nonwoven batting 21 superimposed on and joined to a base. The base provides structural integrity so that the felt may be used in high-speed operations. The batting 21 may have a denier ranging from 1.5 to 40 for the embodiments described herein. It is referred the capillary size of the felt batting 21 be smaller than the capillaries of the foam materials 10 to be dewatered. By correlating the capillary size of the batting 21 to the capillary size of the foam material 10, efficient and effective dewatering can occur.

Dewatering occurs when the capillaries of the felt 20 successfully compete with the capillaries of the foam material 10 for the water contained within the foam material 10. After dewatering, the foam material 10 has a moisture content of 4 to 50%, and more preferably about 10 to 20 percent. All percentages described herein are weight percentages, unless otherwise specified.

Suitable materials for the batting 21 include nylon, polyester and preferably wool. Preferably, the felt 20 has a basis weight and water absorption capacity great enough to dewater the foam material 10 to the desired moisture content and then reject such water before a particular portion of the felt 20 contacts another portion of the foam material 10 to be dewatered. Water may be expelled from the felts 20 using known techniques (not shown). Appropriate felts 20 are commercially available, with Appleton Mills felt 20 56260, and McMaster-Carr felts 20 8755K2 and 8877K42 having been found suitable for use with the present invention. Other suitable commercially available felts 20 include Ed Best Company wool felt 600, Tamfelt nylon felt 2550-23-23 and the Scapa nylon felt 20 8074-S.

As shown in FIG. 1, the felt 20 is brought into contact with an exposed surface of the foam material 10 to be dewatered. This dewatering process may be accomplished by providing two parallel and axially rotatable rolls 22 juxtaposed to form a nip 24 therebetween. The felt 20 and the foam material 10 are disposed in face to face relationship, and interposed in the nip 24. The rolls 22 are loaded together at a pressure ranging from 50 to 8,000 and preferably from 300 to 3,000 pounds per linear inch. Generally, a relatively higher nip 24 loading is preferred so long as the foam material 10 does not tear or rupture.

The foam material 10 and felt 20 are run at constant and equivalent surface speeds through the nip 24. The surface speed of the foam material 10 and felt 20 are matched to the surface speed of the nip 24, to minimize scuffing, shearing and rubbing of the felt 20 or rolls 22 against the foam material 10, thereby minimizing the chances of tearing or breaking the foam material 10 and incurring downtime. For the embodiments described herein, surface speeds ranging from 5 to 500 and preferably 100 to 250 feet per minute have been found suitable.

If desired, plural nips 24 may be utilized to further dewater the foam material 10. Generally, dewatering increases with the number of nips 24, although the amount of dewatering typically becomes attenuated after three to six passes through a nip 24 as discussed in the Examples below.

If desired, one or both of the rolls 22 may be vacuum rolls 22. The vacuum rolls 22 may provide a suction ranging from 3 to 20 and preferably from 12 to 16 inches of Mercury. Such vacuum rolls 22, particularly when in contact with an exposed surface of the foam 10, enhances dewatering. Generally, the vacuum pressure has only a secondary effect on moisture removal.

Figure 2:
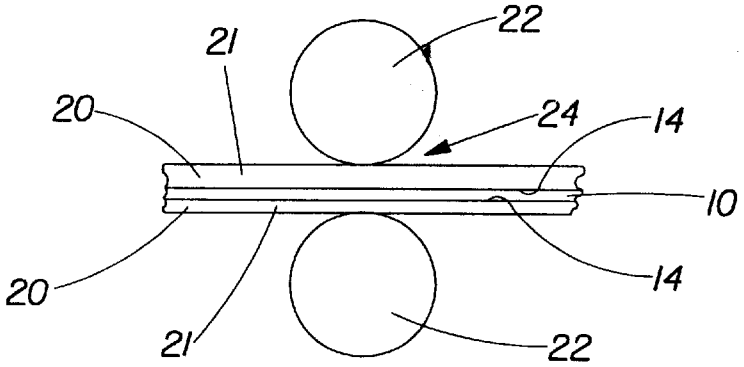
FIG. 2 is a schematic side elevational view, similar to FIG. 1, and having a double felt arrangement.

Referring to FIG. 2, a more significant effect on moisture removal can be achieved by providing two felts 20, first felt 20 and second felt 20 juxtaposed in a double felt 20 arrangement. The first felt 20 and second felt 20 are brought into contact with the first and second opposed faces 14 of the foam material 10. This arrangement provides a laminated double felt 20 arrangement having a central lamina of foam 10 and two outboard laminae of felt 20. This laminated double felt 20 arrangement is run through a dewatering nip 24 as described above. Dewatering with the double felt 20 arrangement is enhanced over the single felt 20 arrangement because moisture is simultaneously removed from both exposed faces 14 of the foam material 10.

The first felt 20 and second felts 20 may be identical, similar or totally different. Using different felts 20 will likely yield a moisture gradient in the Z-direction of the foam material 10.

One or more vacuum rolls 24 may be utilized with the double felt 20 arrangement, as described above for the single felt 20 arrangement. Further, multiple nip 24 arrangements may be used with the double felt 20 arrangement. However, the effect of multiple nips 24 attenuates more quickly using a double felt 20 arrangement than with the single felt 20 arrangement.

Figure 3:
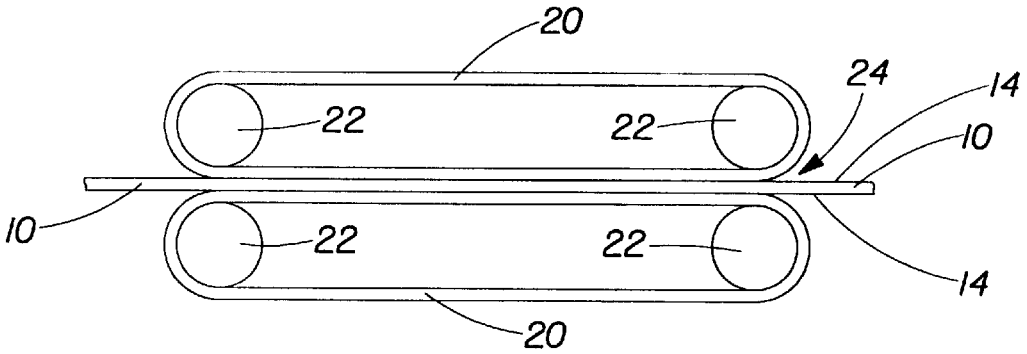
FIG. 3 is a schematic side elevational view of an extended contact arrangement, with the extended contact replacing the nips illustrated in FIGS. 1–2.

Referring to FIG. 3, an extension of the multiple nip 24 arrangement is shown. In FIG. 3, the felt 20 contacts the exposed surfaces 14 of the foam material 10 with an elongate nip for an extended period and length in the machine direction, as illustrated by the elongate contact pattern, rather than just the limited nip 24 width contact illustrated in FIGS. 1 and 2. With continuing reference to FIG. 3, the elongate contact path of the elongate nip allows for further capillary dewatering of the foam material 10. For the embodiments described herein, surface speeds ranging from 5 to 500 feet per minute provide a contact time between the exposed surface of the foam 10 and the felt 20 of 5 to 500 milliseconds.

The embodiment of FIG. 3 provides the benefit that swelling of foam absorbent materials 10, upon wetting, may be controlled as further described in the Examples below. For example, it may be desirable that the foam absorbent material 10, when provided in sheet form, swells more in the Z-direction than in the XY plane, so that a swelling gradient occurs upon wetting. Such a gradient is desirable, because if the foam absorbent material 10 swelled equally in all directions, as a percentage of the original length, the XY plane of the foam 10 would become unwieldy in size and geometry. By providing extended contact and residence time during dewatering, the foam absorbent materials 10 develop a memory which allows the Z-direction to be more readily recaptured upon wetting.

The embodiment of FIG. 3 provides the further advantage that less XY shrinkage of the foam material 10 occurs upon dewatering. For example, a foam material 10 which remains thin until wetted by liquids and dewatered with such an arrangement can experience a shrinkage, upon dewatering, of less than 10%, preferably less than 7½%, more preferably less than 5%, and most preferably less than 2½%, as measured in area in the XY plane. These results provide the obvious benefit of economies and predictability in manufacturing. Further detail is provided below in Examples XXII–XXV and in Table III.

The XY shrinkage may be easily measured by determining the planar rectangular dimensions of the sheet, using, for example, a hand-held Starrett scale or other suitable scale. The XY dimensions of the sheet are measured before and after dewatering. It may be necessary to mark or otherwise ascertain discrete points between which the machine direction measurements can be made for a continuous dewatering process. Once the XY dimensions are determined, shrinkage is given by:

$$[(XY_1-XY_2)/(XY_1)]\times 100\%,$$

wherein $XY_1$ is the area before dewatering and $XY_2$ is the are after dewatering.

Figure 4:
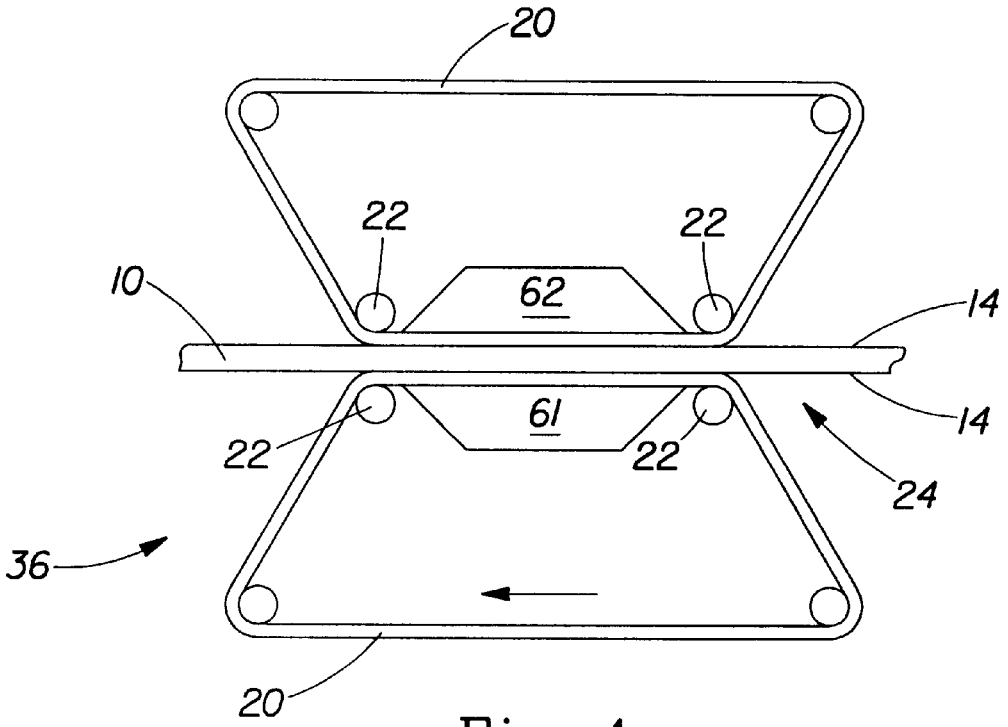
FIG. 4 is a schematic side elevational view of a apparatus having a temperature differential.

Referring to FIG. 4, in an alternative embodiment, the foam material 10 may be dewatered by an apparatus 36 having a felt 20 using an extended nip 24 arrangement as described by commonly assigned Patent Application WO 98/55689 published Dec. 10, 1998 in the names of Trokhan et al., the disclosure of which is incorporated herein by reference. Such an apparatus 36 has a temperature differential and an extended nip 24 arrangement. In this apparatus, the two felts 20 are juxtaposed between a heated side 62 and a cold side 61. Moisture flows from the heated side 62 to the cold side 61 where it condenses. This arrangement further provides the benefit of extended nip 24 contact as described above.

Figure 5:
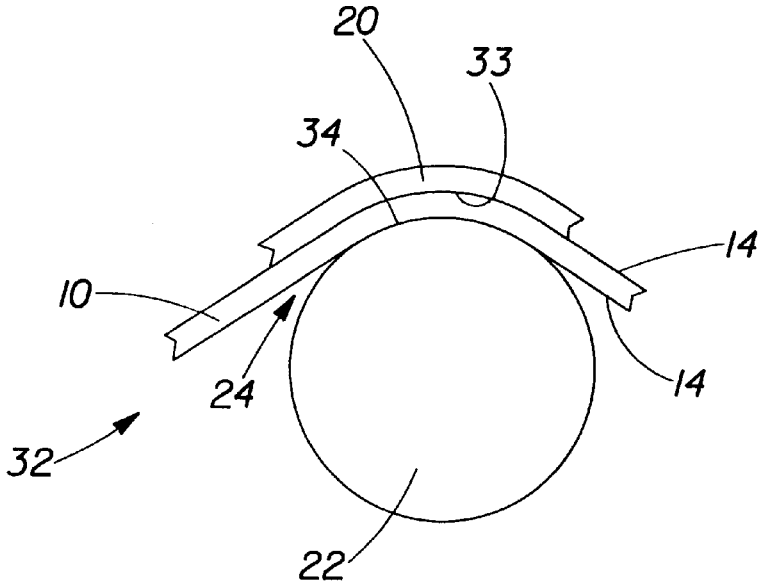
FIG. 5 is a schematic side elevational view of an alternative embodiment according to the present invention utilizing an extended nip press.

Referring to FIG. 5, if desired, one may utilize an arrangement having more than the nip 24 width contact than is provided by the embodiments illustrated in FIGS. 1–2, but less contact than that provided by the arrangements of FIGS. 3–4. In such an arrangement, an extended nip press 32 may be utilized. An extended nip press 32 utilizes an apparatus having mating convex and concave surfaces 33, 34. This geometry provides a contact path, and hence residence time, over a sector of the roll 22 in what is known as a shoe press. A suitable arrangement utilizing an extended nip press 32 in conjunction with a felt 20 having a framework 40 is illustrated in commonly assigned U.S. Pat. No. 5,795,440, issued Aug. 18, 1998 to Ampulski et al., the disclosure of which is incorporated herein by reference.

Figure 6:
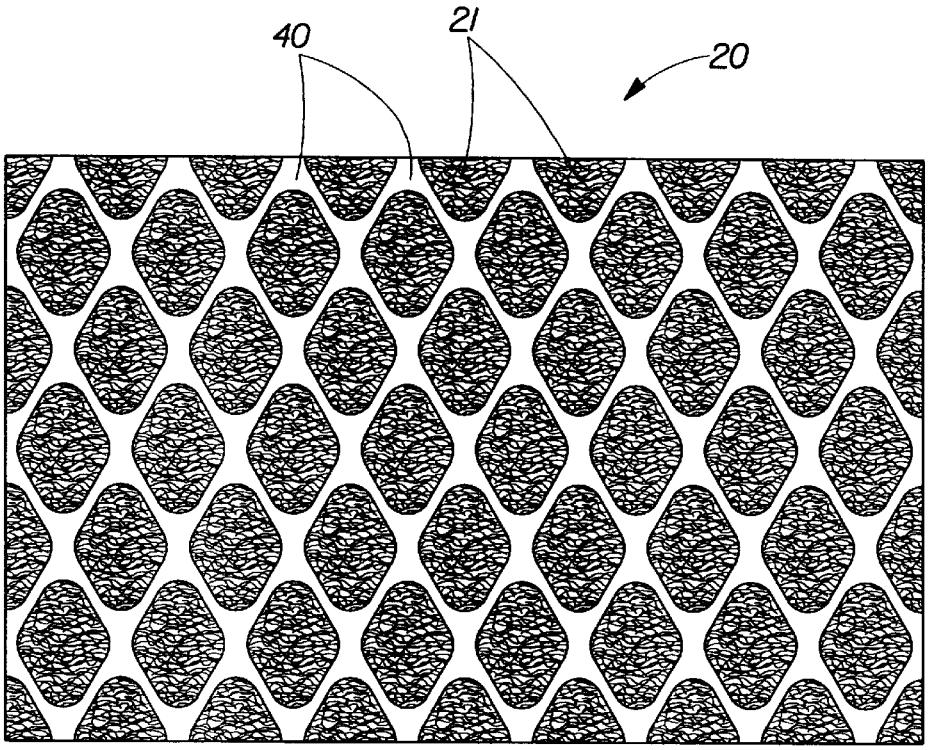
FIG. 6 is a fragmentary top plan view of a felt having a framework thereon.

Referring to FIG. 6, prophetically after curing, the surface 14 of the foam material 10 may be influenced by the texture of the felt 20. If one desires a foam material 10 having a relatively smooth surface, the aforementioned single and double felt 20 arrangements are suitable and a conventional felt 20 may be used. However, one may not always desire a relatively smooth surface 14 for the foam material 10. A textured surface 14 may be desirable in certain situations.

For example, the foam material 10 may be provided with ribs or a hinge line. The hinge line in the foam material 10 provides for controlled buckling or deformation at predetermined sites. Such an arrangement can be particularly useful if the foam material 10 is to be utilized as the core of an absorbent article, and subject to deformation under pressured applied by the wearer.

Alternatively, a foam material 10 having a continuous network of a relatively greater thickness and discrete pockets or blind holes of a lesser thickness within the continuous network may be desirable. The discrete pockets may provide volume for entrapping, immobilizing, and even dewatering fecal material if the foam material 10 is used as a diaper core. Alternatively, the foam material 10 may be provided with discrete regions of a greater thickness and a continuous network of a relatively lesser thickness. Alternatively, any desired pattern of multiple thicknesses may be utilized in the texture.

If desired, both surfaces 14 of the foam material 10 may be provided with a texture. One of ordinary skill will recognize that if the two exposed surfaces 14 of the foam material 10 are provided with a texture, the textures may be the same on each exposed surface 14 or, alternatively, may be different—depending upon the desired application.

A texture on the first, the second, or the first and second exposed surfaces 14 of the foam 10 may be provided as follows. The felt 20 may have a framework 40 extending outwardly from the batting 21. The framework 40 may comprise a photosensitive resin which has the desired pattern. The desired pattern may be continuous, semi-continuous, discrete, or any other pattern envisioned by one of ordinary skill. The framework 40 protrudes outwardly from the batting 21 of the felt 20 and prophetically displaces uncured foam material 10. The regions of the foam material 10 which contact the batting 21 of the felt 20 are dewatered as described above. The regions of the foam material 10 which contact the framework 40 may have the pattern imprinted thereon. Felts 20 having a framework 40, and usable with the present invention to prophetically provide a texture in the surface 14 of the foam material 10 are taught by commonly assigned U.S. Pat. Nos. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; and U.S. Pat. No. 5,861,082 issued Jan. 19, 1999 to Ampulski et al., the disclosures of which are incorporated herein by reference.

It is to be recognized that, upon absorbing water, the texture in the foam material 10 will dissipate and the foam material 10 will return to its original post-cure geometry. Therefore, upon absorption of liquids, the hinge lines, continuous network, or other surface topographies will disappear.

Figure 7:
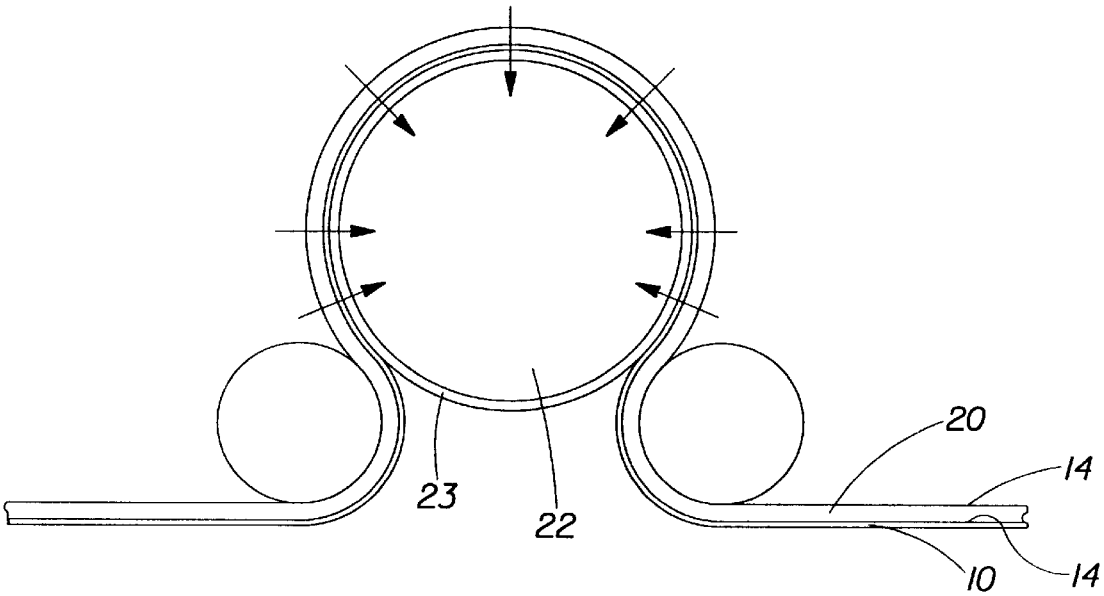
FIG. 7 is a schematic side elevational view of a capillary dewatering roll having a micropore drying medium.

Referring to FIG. 7, the capillary dewatering member need not be a felt 20 at all. In yet another alternative embodiment, the capillary dewatering member may be a roll 22 having a cover 23 with a capillary medium. The capillary medium may have with capillary pores which remove water from the foam material 10 by capillary action. The roll 22 may have a vacuum pressure which is less than the breakthrough pressure of the capillary pores, as illustrated in commonly assigned U.S. Pat. No. 4,556,450, issued Dec. 3, 1985 to Chuang et al., the disclosure of which is incorporated herein by reference.

In operation, the first exposed surface 14 of the foam material 10 is brought into contact with the capillary dewatering roll 22. The foam material 10 may remain in contact with the capillary dewatering roll over an extended sector ranging from about 20 degrees to about 310 degrees.

If desired, the capillary dewatering member may provide a limiting orifice for airflow through the foam 10 and the drying member. The limiting orifice may be executed as a roll cover 23, as described above. One suitable limiting orifice roll cover 23 is a laminate comprising a micropore medium.

The cover 23 comprises a plurality of laminae, each of successively decreasing pore size. The lamina having the finest pores is placed in contact with the exposed surface of the foam material 10. The laminae having larger pores, are consecutively placed away from the foam material 10 to be dewatered and provide structural rigidity to the laminate. If desired, such a micropore medium may be provided with plural zones, a first zone having a capillary dewatering section held at less than breakthrough vacuum as described above, and one or more successive zones in which the vacuum is greater than the breakthrough pressure. Suitable limiting orifice capillary drying members are illustrated in commonly assigned U.S. Pat. Nos. 5,274,930, issued Jan. 4, 1994 to Ensign et al.; U.S. Pat. No. 5,437,107, issued Aug. 1, 1995 to Ensign et al.; U.S. Pat. No. 5,539,996, issued Jul. 30, 1996 to Ensign et al.; U.S. Pat. No. 5,581,906, issued Dec. 10, 1996 to Ensign et al.; U.S. Pat. No. 5,584,126, issued Dec. 17, 1996 to Ensign et al.; U.S. Pat. No. 5,584,128, issued Dec. 17, 1996 to Ensign et al.; and U.S. Pat. No. 5,625,961, issued May 6, 1997 to Ensign et al.; the disclosures of which are incorporated herein by reference.

Referring back to FIGS. 1–2, it is to be recognized that various other capillary dewatering members may be used for the roll 22. For example, solid rolls 22 may be covered to provide a periphery of felt 20 as described above. The felt 20 may be a conventional felt 20 or a felt 20 having a framework 40 thereon. Of course, either or both of the rolls 22 may be provided with such a felt 20 cover 23. One of ordinary skill will recognize that a combination of rolls 22, one having a conventional felt 20 and one having a felt 20 with a framework 40 thereon may be utilized, as well as two similar or identical rolls 22. Further, it is not necessary that both of the rolls 22 have capillary dewatering capability.

In yet another alternative, the roll(s) 22 may have the capillary dewatering member integral therewith. For example, the entire roll(s) 22 could be constructed of felt 20 except for only a shaft of solid and rigid material necessary to transmit rotation to the roll(s) 22.

If desired, prophetically the cured foam material 10 may be foreshortened. Foreshortening the foam material 10 provides the prophetic benefit of energy absorption, particularly when the foam material 10 undergoes tension in the machine direction. Foreshortening may be accomplished by creping. During creping, the foam material 10 is adhered to a rigid surface, such as one of rolls 22 described above. A doctor blade, as is well known in the art, is used to abruptly remove the foam material 10 from the rigid surface in the creping process. Creping may be accomplished according to commonly assigned U.S. Pat. No. 4,919,756, issued Apr. 24, 1992 to Sawdai, the disclosure of which is incorporated herein by reference.

Alternatively, foreshortening may be accomplished by transferring the foam material 10 from a first moving surface to another, slower moving surface. Transfer of the foam material 10 from one moving surface to a second moving surface having a slower surface velocity causes foreshortening of the foam material 10. Foreshortening in this manner may be accomplished as taught in commonly assigned U.S. Pat. No. 4,440,597, issued Apr. 3, 1984 to Wells et al., the disclosure of which is incorporated herein by reference.

Of course, similar to the surface texture effect cited above, upon absorbing water or other liquids, a foreshortened foam material 10 will return to its original geometry. Thus, foreshortening would be only a temporary phenomenon, and last only while the foam material 10 is in a dry state.

The foam material 10 may be comprised of an integral sheet which is formed as a unitary structure as described above. Alternatively, the foam material 10 may be comprised of individual particulates. Such foam material 10 may be laid as individual particulates onto a forming screen. The particulates may have a size ranging from about 0.1 to about 10 mm. The particulates are then transferred to felt 20 and compressed, where the particulates of foam material 10 are held together by capillary forces.

If desired, several sheets of foam material 10 may be stacked together for simultaneous and parallel dewatering. This arrangement provides the benefit that multiple sheets can be dewatered at the same time, without requiring additional lines for increased throughput. The arrangement having a plurality of stacked sheets of the foam material 10 may produce a gradient in final moisture distribution between the sheets in the center of the stack and the outermost sheets which contact the felt 20. Thus, such an arrangement will prophetically work better with foam materials 10 having a relatively high liquid permeability.

Prophetically, other materials could be used for the capillary dewatering member 20. For example, the capillary dewatering member 20 could prophetically be made of cellulose. The cellulosic capillary dewatering member 20 may be reinforced and have a laminated construction. Woven plies of the laminate, as are known in the belt-making art, could be provided. The cellulosic capillary dewatering member 20 is superimposed on the woven plies for strength. This arrangement provides the benefit that the capillary dewatering member 20 is disposable. A new capillary dewatering member 20, tailored to have different properties, could be superimposed in the laminated construction as desired.

Various embodiments and/or individual features are disclosed herein. All combinations of such embodiments and features are possible and can result in preferred executions of this invention.

EXAMPLES

Examples I–VI

Figure 8:
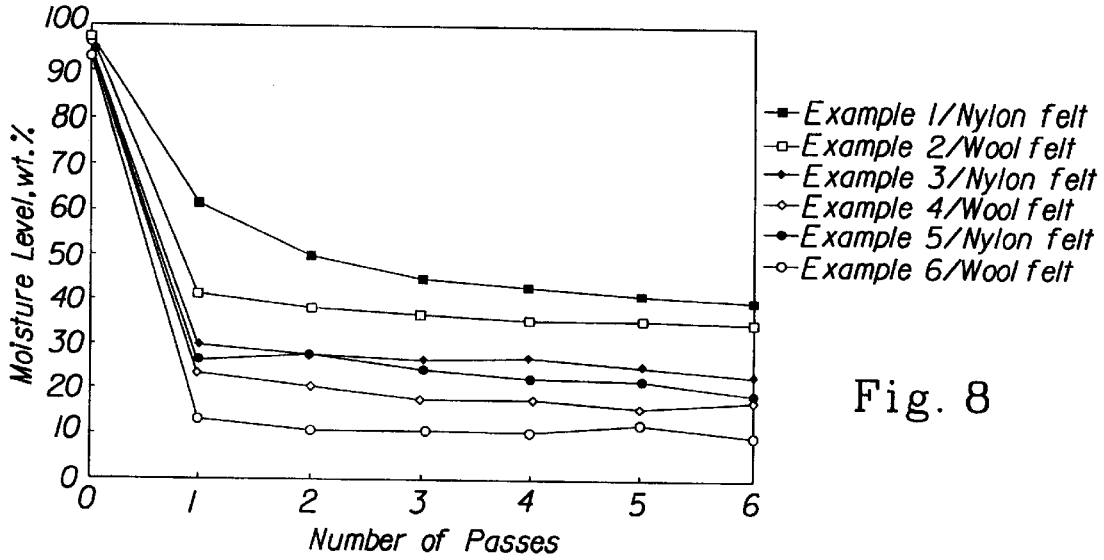
FIG. 8 is a graphical representation of the dewatering performance of up to six consecutive nips on three different foam materials.

Referring to FIG. 8, six samples were run in order to test the effects of the number of passes through the dewatering nip(s) 24 on three different types of foam absorbent material 10.

Examples I–II were run on a foam absorbent material 10 having an initial water-to-oil ratio of 45:1.

Examples III–IV were run on a foam absorbent material 10 having an initial water-to-oil ratio of 30:1.

Examples V–VI were run on a foam absorbent material 10 having an initial water-to-oil ratio of 16:1.

Examples I, III and V utilized the aforementioned nylon felt 20. Examples II, IV and VI utilized the aforementioned wool felt 20.

Each of Examples I–VI were run at a nip 24 pressure of 1600 pli, a speed of 100 ft./min. and a dewatering vacuum of 3 in. Hg. FIG. 8 illustrates that for each of the three foam absorbent material 10 sample pairs, the wool felt 20 provided greater dewatering than the nylon felt 20.

FIG. 8 also illustrates that the dewatering increases (i.e., moisture decreases) with the first pass through the nip 24, and for the foam material 10 of Examples I–II with the second-third passes. But, generally, Examples III–VI show the second through sixth passes through the dewatering nips 24 have little, if any, effect on dewatering of those foam materials 10. Thus, it appears the dewatering benefit of multiple nips 24 is governed by the specific foam material 10 under consideration.

Examples VII–XII

Figure 9:
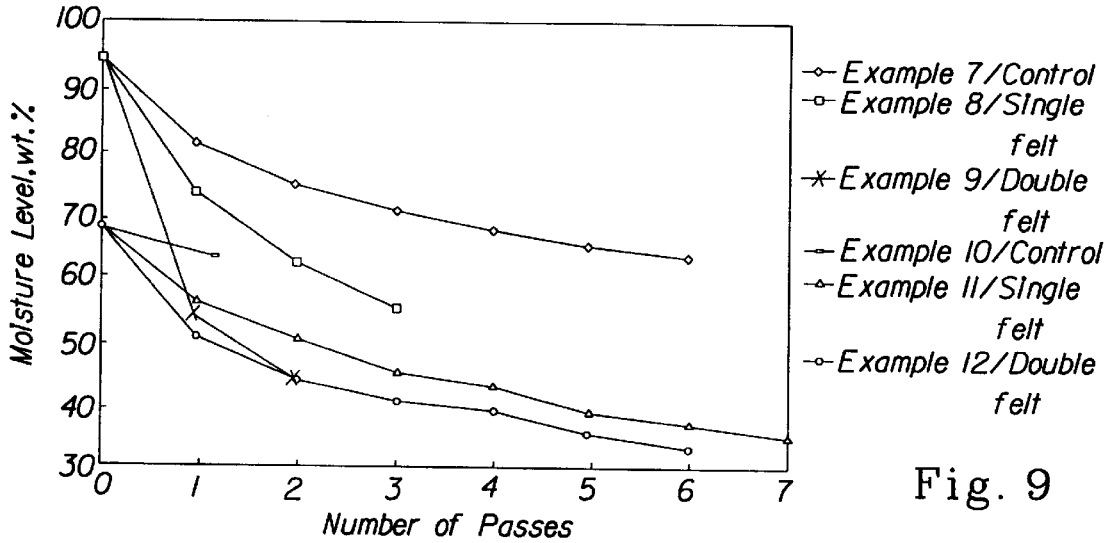
FIG. 9 is a graphical representation of the dewatering performance of up to seven different nips on a single foam material beginning at two different initial moisture levels.

Referring to FIG. 9, Examples VII–XII examine the effect of the number of passes on dewatering from two different initial moisture levels. Examples VII–IX had an initial moisture level of 97%. Examples X–XII had an initial moisture level of 69%. Each of Examples VII through XII used the foam material 10 of Examples I–II at a speed of 20 ft./min., a compression of 240 pli, and a vacuum pressure of 12.5 in. Hg using a nylon felt 20. %. Examples VII!IX utilized a control having no felt in the nip 24, single felt and double felts 20, respectively. Examples IX–XII utilized a control, single felt 20 and double felt 20 arrangements, respectively.

Examples VII–IX show that using even a single felt 20 at a 240 pli nip 24 load leads to lower moisture levels than the control and that double felts 20 outperform single felts 20. Further, at the 240 pli nip 24 load, moisture removal increases with each succeeding pass through the nip 24. These results are different than those of Examples I–VI above.

Without being bound by theory, it is believed that the difference in moisture removal from subsequent nips 24, in Examples VII–XII, occurs because of the lower nip 24 loading (240 pli) than was used in Examples I–VI (1600 pli). Thus, the dewatering effect of multiple passes through a nip 24 appears to be inversely related to the compressive loading forces of the nip 24.

Examples XIII–XV

Figure 10:
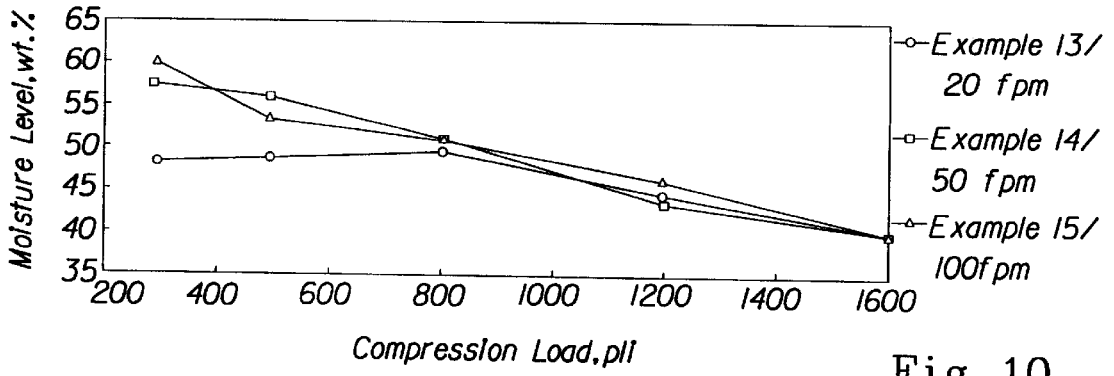
FIG. 10 is a graphical representation of the dewatering performance of five different nip loads on a single foam absorbent material taken over three different speeds.

Referring to FIG. 10, Examples XIII–XV show the effect of the nip 24 load for a single nip 24 at three different line speeds. Example XIII had a line speed of 20 ft./min., Example XIV had a line speed of 50 ft./min. Example XV had a line speed of 100 ft./min. Examples XIII–XV used the foam material 10 of Examples I–II and VII–XII at an initial moisture level of 97%, a double wool felt 20 arrangement and a vacuum pressure of 3 in. Hg.

FIG. 10 shows the effect of speed on water removal is negligible over the range of 300–1600 pli at speeds of 50 and 100 ft./min. For compressive loads less than 800 pli, a speed of 20 ft./min. yields lower moisture levels than the 50 and 100 ft./min. speeds. Moisture levels at compressive loads greater than about 800 pli are substantially equivalent and thus independent of the speed.

Without being bound by theory, it is believed the convergence of the dewatering curves at greater nip 24 loadings occur because the flow paths in the capillaries of the foam absorbent material 10 become more torturous. At lesser nip 24 loadings, the longer residence time at the 20 ft./min. speed is not great enough to cause more water removal.

Examples XVI–XVIII

Examples XVI–XVIII tested single pass moisture levels for the three foam absorbent materials 10 described above in to Examples I–II, III–IV and V–VI, respectively, using the three different felts 20.

Examples XVI–XVIII were run at a speed of 20 ft/min. through a single nip 24 loaded at 300 pli, using a vacuum of 16 in. Hg. The data are summarized in Table I.

TABLE I

| | | 1st Pass Moisture levels, wt. % | | |
|---|---|---|---|---|
| Felt Arrangement | Inital Moisture Level - wt. % | Wool Felt | Polyester Felt | Nylon Felt |
| Example XVI | 97 | | | |
| Single Felt | | 56.9 ± 2.2 | 63.5 ± 1.2 | 72.0 ± 3.7 |
| Double Felt | | 23.4 ± 0.2 | 52.8 ± 3.0 | 49.3 ± 0.7 |
| Example XVII | 96 | | | |
| Single Felt | | 51.6 ± 0.6 | 56.3 ± 1.6 | 54.3 ± 2.7 |
| Double Felt | | 18.7 ± 0.3 | 47.0 ± 0.8 | 28.3 ± 0.6 |
| Example XVIII | 91 | | | |
| Single Felt | | 47.5 ± 0.4 | 49.3 ± 1.3 | 49.6 ± 1.0 |
| Double Felt | | 6.2 ± 0.1 | 39.5 ± 0.6 | 39.9 ± 1.3 |

Table I verifies that the wool felt 20 outperforms the nylon and polyester felts 20 for each of the three foam materials 10. The polyester and nylon felts 20 showed generally equivalent performance for the foam material 10 of Examples XVI and XVIII. In Example XVII, the nyon felt 20 outperformed the polyester felt 20. For the double felt 20 arrangement, all of Examples XVI–XVIII provided lower moisture levels than the single felt 20.

the foam material 10 to be restrained more, thus less shrinkage occurs. The effect of the nip 24 load appears to be less significant than that of the speed. A high compression load slightly correlates to less shrinkage.

TABLE III

| Conditions | 1st Pass | | Dimensions Before Dewatering | | | Dimensions After Dewatering | | | |
|---|---|---|---|---|---|---|---|---|---|
| Compression | Moisture Levels | | MD | CD | | MD | CD | | |
| load/Speed/Vac. Pressure | Wt. % | g water/g dry FAM | Length, in. | Width, in. | MD X CD, in$^2$ | Length, in. | Width, in. | MD X CD, in$^2$ | Shrinkage % |
| EXAMPLE XXII: 300 pli/20 fpm/ 3 in. Hg | 49 | 1.0 | 10.5 | 2.5 | 26.4 | 10.4 | 2.5 | 26.1 | 1.2 |
| EXAMPLE XXIII: 300 pli/100 fpm/ 3 in. Hg | 50 | 1.0 | 10.6 | 2.5 | 26.5 | 10.5 | 2.4 | 25.0 | 5.4 |
| EXAMPLE XXIV: 1600 pli/20 fpm/ 3 in. Hg | 38 | 0.6 | 10.5 | 2.5 | 26.3 | 10.5 | 2.5 | 26.3 | 0.0 |
| EXAMPLE XXV: 1600 pli/100 fpm/ 3 in. Hg | 39 | 0.6 | 10.5 | 2.5 | 26.3 | 10.5 | 2.4 | 24.9 | 5.0 |

Examples XIX–XXI

Referring to Table II, the foam material 10 of Examples I–II, VII–XII, and XIII–XV was tested in single and double nylon felt 20 arrangements to determine effect of the number of passes on the Z-direction caliper. A nip 24 pressure of 240 pli was used with a vacuum of 16 in. Hg at a speed of 20 ft./min. The initial caliper was 0.185 inches.

For each of Examples XIX–XXI, with the single felt 20 arrangement, the control (not having felt 20) significantly reduced the caliper. The difference in caliper reduction between one and three passes through the nips 24 was not found to be significant. Nor, does a significant further reduction in caliper occur with six passes through the nip 24.

TABLE II

| | Number of Passes | Thin Caliper, inches Single Felt | Double Felt |
|---|---|---|---|
| | 1 (Control without felt) | 0.054 | — |
| Example XIX | 1 | 0.029 | 0.027 |
| Example XX | 3 | 0.028 | 0.026 |
| Example XXI | 6 | 0.024 | 0.022 |

Examples XXII–XXV.

Examples XXII–XXV test the effects of dewatering on shrinkage in the X-Y plane. Examples XXII–XXV used the same foam material 10 as in Examples I–II, VII–XII, XII-I–XV and XIX–XXI, at an initial moisture level of 97% and a vacuum pressure of 3 in. Hg and using a double wool felt 20 arrangement. Four conditions were run using nip 24 pressures of 300 and 1600 pli and speeds of 20 and 100 ft./min.

Table III shows that at a constant nip 24 load, increasing the speed results in increased shrinkage. Without being bound by theory, it is believed that the greater residence time in the nip 24 at the relatively slower 20 ft./min. speed causes

What is claimed is:

1. A process of removing moisture from a foam material, said process comprising steps of:

providing a foam material, said foam material being substantially hydrophobic and having at least one exposed surface, capillaries and moisture contained therein;

providing a capillary dewatering member; and bringing said capillary dewatering member into contact with said exposed surface of said foam material, whereby said moisture may be removed from said foam material.

2. The process according to claim 1 wherein said step of providing a capillary dewatering member comprises providing an endless felt.

3. The process according to claim 2 wherein said step of providing said felt comprises providing a felt having a batting and a framework extending outwardly from said batting.

4. The process according to claim 1 wherein said step of providing a foam material comprises providing a foam material in sheet form, whereby said foam material has first and second opposed surfaces.

5. The process according to claim 4 wherein said step of bringing said capillary dewatering member into contact with said exposed surface of said foam comprises providing two axially rotatable rolls; juxtaposing said rolls together to form a nip therebetween;

providing an endless felt for said capillary dewatering member;

placing said capillary dewatering member and said foam material in face-to-face relationship;

interposing said capillary dewatering member and said felt in said nip formed by said two rolls; and moving said capillary dewatering member and said foam material relative to said rolls.

6. The process according to claim 5 further comprising steps of providing a second endless felt, so that there is a first endless and a second endless felt;

juxtaposing said first endless felt with said first exposed surface of said foam material;

juxtaposing said second endless felt with said second exposed surface of said foam material to thereby form a laminate; and interposing said laminate in said nip, whereby water may be removed from said first exposed surface and said second exposed surface of said foam material into said first felt and said second felt, respectively.

7. The process according to claim 6 wherein said two felts are disposed in face-to-face relationship to provide an elongate nip, said foam material being interposable in said elongate nip.

8. The process according to claim 4 wherein said foam material comprises an integral sheet.

9. The process according to claim 4 wherein said foam material comprises individual particulates.

10. The process according to claim 1 wherein said step of providing a substantially hydrophobic foam material comprises providing a foam material prepared by polymerization of a continuous phase of a high internal phase emulsion that has been squeezed and washed to substantially remove residual electrolyte, residual emulsifier, and residual polymerization initiator.

11. A process of removing moisture from a foam material, said process comprising steps of providing a foam material, said foam material being substantially hydrophobic and having at least one exposed surface, said exposed surface having capillaries with moisture contained therein;

providing a capillary dewatering member in the form of an axially rotatable roll, said capillary dewatering member having peripherally disposed capillary pores therethrough, whereby moisture contacting said periphery of said roll can enter said capillary pores; and disposing said foam matarial on said periphery of said capillary dewatering member.

12. A process according to claim 11 wherein said step of providing a roll having peripheral capillaries comprises providing capillaries in said roll which are smaller than said capillaries in said foam material.

13. A process according to claim 12 wherein said step of providing a roll having said peripheral capillaries comprises maintaining said peripheral capillaries at a vacuum less than the breakthrough pressure of said capillaries.

14. The process according to claim 12 further comprising through air drying of said foam material with air flow therethrough.

15. The process according to claim 11 wherein said step of providing said peripheral capillaries comprises providing said peripheral capillaries at a vacuum pressure greater than the breakthrough pressure of said capillaries.

16. The process according to claim 15 wherein said step of providing peripheral capillaries comprises providing peripheral capillaries which present a limiting orifice to said airflow through said foam material.

17. A process for dewatering a foam material, said process comprising steps of:

providing a foam material, said foam material being substantially hydrophobic and having first and second opposed surfaces defining an XY plane, said foam material having capillaries with moisture contained therein;

providing an elongate nip, said elongate nip comprising first and second opposed surfaces juxtaposed to form said elongate nip therebetween, at least one of said first and second opposed surfaces comprising a capillary dewatering member;

interposing said foam material in said elongate nip; and removing said foam material from said elongate nip wherein moisture is removed from said foam material and said foam material exhibits a shrinkage in the XY plane of less then 10%.

18. The process according to claim 17 wherein said shrinkage in said XY plane is less than 5%.

19. The process according to claim 17 wherein said first and second surfaces comprising said elongate nip each comprise a capillary dewatering member, whereby both said first and second surfaces of said foam material are simultaneously dewatered.

* * * * *

UNITED STATES PATENT AND TRADEMARK OFFICE

CERTIFICATE OF CORRECTION

PATENT NO. : 6,240,654 B1
DATED : June 5, 2001
INVENTOR(S) : Weber et al.

It is certified that error appears in the above-identified patent and that said Letters Patent is hereby corrected as shown below:

Title page,
Item [73], Assignee, please delete "Proctor" and insert therefor -- Procter --.
Item [57], ABSTRACT,
Line 11, please delete "is" and insert therefor -- are --

Column 6,
Line 22, please delete "Theological" and insert therefor -- rheological --.

Column 8,
Line 40, please delete "SPAN®" and insert therefor -- SPAN® --.

Column 11,
Line 7, please delete "Processinq" and insert therefor -- Processing --.

Column 13,
Line 8, please delete "52 musec." and insert therefor -- 52 mL/sec. --.

Column 21,
Line 61, please delete "20. %." and insert therefor -- 20. --.
Line 61, please delete "VII!IX" and insert therefor -- VII-IX --.

Column 24,
Table III, please delete the heading of the table and replace it with the following:

| Conditions | 1st Pass Moisture Levels | | Dimensions Before Dewatering | | | Dimensions After Dewatering | | | Shrinkage |
|---|---|---|---|---|---|---|---|---|---|
| Compression load/Speed/Vac. Pressure | Wt. % | g water/g dry FAM | MD Length, in. | CD Width, in. | MD X CD, $in^2$ | MD Length, in. | CD Width, in. | MD X CD, $in^2$ | % |

UNITED STATES PATENT AND TRADEMARK OFFICE

CERTIFICATE OF CORRECTION

PATENT NO. : 6,240,654 B1
DATED : June 5, 2001
INVENTOR(S) : Weber et al.

It is certified that error appears in the above-identified patent and that said Letters Patent is hereby corrected as shown below:

Column 26,
Line 34, please delete "then" and insert therefor -- than --.

Signed and Sealed this

Thirteenth Day of July, 2004

JON W. DUDAS
*Acting Director of the United States Patent and Trademark Office*